United States Patent [19]

Rodriguez

[11] 4,421,610

[45] Dec. 20, 1983

[54] ELECTROLYTIC COLORING PROCESS

[76] Inventor: Dionisio Rodriguez, General Mola, 74-8a, Planta, Madrid - 6, Spain

[21] Appl. No.: 254,589

[22] Filed: Apr. 16, 1981

[30] Foreign Application Priority Data

Jan. 16, 1981 [ES] Spain ..... 498.578

[51] Int. Cl.[3] ..... C25D 11/22

[52] U.S. Cl. ..... 204/35 N; 204/42; 204/58; 204/DIG. 9

[58] Field of Search ..... 204/35 N, 58, 38 A, 204/42, DIG. 9

[56] References Cited

U.S. PATENT DOCUMENTS

| | | | |
|---|---|---|---|
| 3,634,208 | 1/1972 | Kuroda | 204/35 N |
| 3,929,593 | 12/1975 | Sugiyama et al. | 204/35 N |
| 3,959,090 | 5/1976 | Höllrigl et al. | 204/28 |
| 4,021,315 | 5/1977 | Yanagida | 204/35 N |
| 4,022,671 | 5/1977 | Asada | 204/42 |
| 4,042,468 | 8/1977 | Hasegawa et al. | 204/42 |

*Primary Examiner*—G. L. Kaplan
*Assistant Examiner*—William Leader
*Attorney, Agent, or Firm*—Wigman & Cohen

[57] ABSTRACT

An electrolytic coloring process for aluminum or aluminum alloy is disclosed in which the aluminum is subjected to electrolytic treatment, in the absence of metal salts, in a low disolution electrolyte having a chemical activity equivalent to less than an $H_2SO_4$ concentration of 4gm/liter, by applying an alternating current having a peak voltage of between 55 and 85 volts and a current density of less than 0.3 amp/dm$^2$ and then treating the aluminum in an acid electrolyte containing a metal salt, again using alternating current of the same peak voltage range.

3 Claims, 12 Drawing Figures

FIG. 6
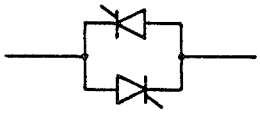
FIG. 7
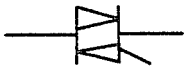
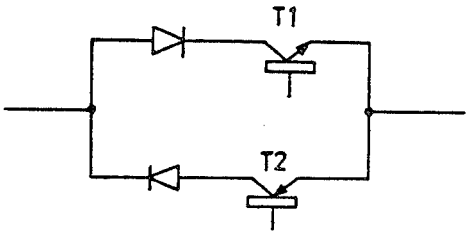
FIG. 8
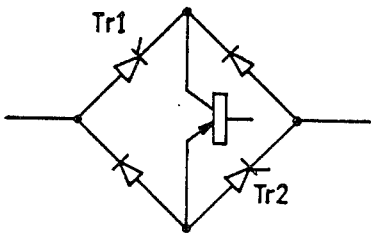
FIG. 9

ELECTROLYTIC COLORING PROCESS

The present invention refers to an electrolytic coloring process for the manufacture of colored aluminum or aluminum alloy sections (profiles) for architectural use, and having a superficial layer or plating which satisfies the quality requirements of EURAS EWAA (European Anodizers and European Wrought Aluminum Association).

As is already known in the technical field of anodization of aluminum and its alloys, the formation of the porous film of aluminum oxide on said metal and its alloys is due to the simultanious action of oxidation and disolution of the electrolyte. It is also known that the oxidation is due to the electrical parameters and the conductivity of the electrolyte, while the disolution is directly related to the concentration of the electrolyte and its temperature which, in turn, depends on the electrical energy due to the Joule effect.

Consequently, the values of these parameters, such as: concentration, density of the current, voltage, conductivity, temperature, efficiency in the dissipation of heat due to the Joule effect, uniformity of the distribution of current on the charge to be anodized, etc., are to be kept within specific limits.

French Pat. No. 1,399,797, granted Apr. 12, 1965 to Mr. Dionisio Rodriguez Martinez, describes and claims a process for the anodic oxidation of aluminum and its alloys, in which chromic acid is used as electrolyte. This prior technology leads to important improvements in the anodization treatment, such as: substantial energy saving, decrease in the ratio volume of bath/surface to be treated, decrease in the requirement for electrical contact and the possibility of anodization of the various sections or pieces disposed in a staggered configuration, for example, the disposition of tubes in a heat exchanger.

As is already known, the electrolytic coloring of anodized aluminum requires the use of an electrolyte, preferably acid, that contains one or more metal salts similar to those used in electrodeposition processes. By means of the application of an alternating current, the deposition of the metal corresponding to the cations of the salts that are present in the electrolyte is effected. These metalic particles that are deposited are the ones responsible for the subsequent coloring. Mentioned deposition occurs in a surprising way since, as is known, if an alternating current were used in a conventional electrodeposition process, said deposition would not occur since, evidently, the deposition effected during the phase in which the section has a negative polarity would dissolve in the opposite polarity phase. Nevertheless, this does not happen when applying an alternating current if the process is effected on aluminum sections that have been priorly anodized. This is due to the fact that the non-porous layer of anodic film (commonly known as a barrier layer or dielectric layer) has a semiconductor characteristic, in the sense of allowing an increase in the passage of current when the polarity of the section of aluminum is negative. This favors the deposition effect as compared to the disolution, the final effect being the production of a deposition of metalic particles.

In conventional electrolytic coloring technology, the following disadvantages are found:

(1) The uniformity of the color is closely related with the quantity of metal particles deposited, and the greater will be the uniformity as less is the difference in structure and electric characteristics of the anodic film corresponding to those sections or pieces which are more accesible and those that are more hidden.

In practice, the priorly mentioned differences are reduced by conveniently separating the sections to be treated with the purpose of making the disolution effect of the anodization bath as uniform as possible. This subsequently results in a decrease in the number of sections to be treated in the coloring stage as compared to the anodization capacity per se.

(2) In order to obtain uniformity in color in those sections that are most hidden, or located in less accessible zones with respect to the flow of current, the process would require increasing the voltage applied in order to favour the deposition in mentioned most hidden sections. This phenomenon, which is known as screen effect, is caused by the tendency of the sections surrounding those in less accessible zones to absorb more current. On the other hand, since preference is given to using acid electrolytes, we find that there are protons present having a charge equal to those of the metallic cations and greater in mobility than this last mentioned, due to the dissociation of said acids. The deposition of said protons provokes the formation of nascent hydrogen which tends to dissolve the barrier layer or film, thus weakening its thickness with the corresponding risk of also weakening the fastening or connection of the anodic film to base metal, even to the extent of reaching points in which the scaling or spalling of the anodic layer is produced.

For the same reason as in the prior case, this would require a greater separation of the sections in order not to be forced to increase the voltage to be applied. In the same manner, in practice this inconvenience leads to a decrease in the production capacity of the coloring line.

On the other hand, and with reference to the electric model detailed in Spanish Pat. No. 437,604, the present invention uses an electric model representative of the load of sections to be colored, said model being illustrated in FIG. 1 of the enclosed drawings.

In said FIG. 1, $R_e$ represents the electrical resistance of the electrolyte; C represents the capacity due to the barrier film; $R_p$ is the electrical resistance resulting from the porosity of the anodic film; and $R_A$ and $R_B$ represent the resistances (electric) to the passage of the current through the barrier film in both directions of circulation of the current, with these resistances being different due to the semiconductor character of the barrier film.

From the electric model detailed in FIG. 1 one may see that one way of obtaining color uniformity in most hidden parts of the section to be colored consists in seeing to it that electrical resistance $R_e$, corresponding to those areas of the section to be colored that are more accessible as well as those that are less accessible, should be appreciably less than the resistance represented by $(R_p+R_A)$ or $(R_p+R_B)$. In practice, one may proceed in one of two ways in order to increase $R_p$:

- by producing a very thick film, of about 20 to 25 microns, with the porosity corresponding to conventional anodization conditions of an anodization in a sulfur medium, or
- by producing a film of a lesser thickness, but lessening the porosity by modifying the anodization conditions and using electrolytes having lesser dissolution powers.

In spite of what has been mentioned priorly, the values of $(R_p+R_A)$ or $(R_p+R_B)$ may be very different between the more accesible and less accesible parts of the section to be colored, which results in differences in coloring during the electrolytic coloring process. These differences in coloring will be decreased when a barrier film is more uniform on the different sections of a load and on different surfaces of one same section or piece. This can be obtained, as mentioned before, by separating the sections to be anodized, with the subsequent inconvenience of a reduction in production capacity.

One way of reducing the difference between the values of $(R_p+R_A)$ or $(R_p+R_B)$ between the different parts of the anodized load that would be more or less accessible with respect to the current consists in using the process described in Japanese Patent No. 101740-1976. This is accomplished by applying a direct current in the same electrolyte of metal salts that is later used for the electrolytic coloring with alternating current. This treatment, prior to coloring, evidently results in equalling the values of $R_A$ and $R_B$ between the those parts that would be more or less accesible, but this would not change the value of $R_p$, thus resulting in a tendency to reduce the differences between the values of $(R_p+R_A)$ or $(R_p+R_B)$ between mentioned more or less accesible parts of the load and, consequently, a greater uniformity is obtained. Nevertheless, the system detailed by said Japanese patent has the inconvenience of destroying part of the components of the electrolyte and, at the same time, consume the cations of the metalic salts since these deposit on the electrodes acting as cathodes.

(3) The technology of electrolytic coloring which, as already mentioned before, is the application of conventional electrodeposition electrolytes, is limited to those electrolytes that, due to their conductivity and acidity, do not require the application of high voltages, due to the inconveniences already mentioned in the prior section.

According to the present invention, the inconveniences of the prior technology are obviated by the coloring process which follows the following stages:

(a) anodization of the aluminum;

(b) preparatory electrolytic treatment of the coloring with alternating current, which is termed "precoloring";

(c) electrolytic coloring.

For the anodization phase (a), any of the conventional methods may be used, without any limit whatsoever. It is evident that said phase (a) (anodization) does not form part of the novelty of the present invention.

For "precoloring" phase (b), a low power of disolution electrolyte is used, basically formed by sulfuric acid at a concentration of less than 4 gm/lt., or another acid that can supply a concentration equivalent in $H^+$ protons in case the electrolyte to be used in the next stage (c) should be incompatible with sulfuric acid. In this stage (b) of the process of the invention, not only is it possible to balance or equal the values of $R_A$ and $R_B$ between the areas of the section to be colored that could be more or less accesible, but also, in the phase where the aluminum is negative, the action of the charged hydrogen formed reduces or equals the values of $R_p$; thus, the values of $(R_p+R_A)$ or $(R_p+R_B)$ between the areas of the section to be colored that could be more or less accesible come closer, when compared to the technology used in the mentioned Japanese patent. On the other hand, the mentioned inconvenience of the destruction of the components of the coloring electrolyte is avoided.

During the precoloring phase, a measure of the impedance of the load of sections is obtained, which serves as a reference to fix the conditions of the current to be applied to the latter phase of coloring. This reference is applied automatically in the coloring phase or stage, in case programming is done by means of microprogrammers.

Another characteristic of phase (b) of the precoloring stage of the process of this invention resides in effecting same by means of applying an alternating current with a peak voltage of between 55 and 85 volts and a current density of less than 0.3 amp/dm$^2$.

According to the above, the application of alternating current in the precoloring phase of the process of this invention is translated or results in the additional advantage that, in said coloring phase, a greater range of electrolytes may be used as compared to those of conventional coloring processes, resulting in the possibility of being able to use more new colors in the future.

The last stage (c) of the process of this invention covers the coloring of the sections or pieces pretreated in phase (b), by means of electrodeposition of an electrolyte based on sulfuric acid and a compound of a metal selected from the group composed of nickel, cobalt, copper, tin, cadmium or alloys of these, by means of applying an alternating current at a peak voltage equal to that applied in the precoloring phase, i.e., between 55 and 85 volts.

As an alternative source of energy for the electrolytic vat of this or any other similar process, a polyphase network connected directly, or through a transformer, to an electronic switch that controls the condition periods may be used.

The electronic switch or device used provides the advantage, over those known to date, of absorbing energy on an equal basis from the polyphase system, resulting in that the electric network source is balanced.

The prior processes used, as a source of alternating current energy, a monophase line, one phase of a polyphase system, one polyphase line with a polyphase transformer at primary and monophase at secondary, or other sophisticated processes, but with the inconvenience, if the monophase system is not considered, of resulting in important inequilibriums in the phases of the energy distribution system; in this way, the advantages that a polyphase network offers consumers of electric energy are reduced, the savings resulting from the polyphase source are not obtained with conventional source of energy systems.

This invention, using practically the same means that have been used in traditional processes, results in obtaining a polyphase electric source of energy, an alternating current source with a controlled conduction angle, that equally charges the three phases of the polyphase system, independently of the number of phases under consideration, not only without losing the possibilities of conventional systems, but additionally giving all the modalities that a control of their separation offers.

In order to obtain a balance between the phases, which is an object of this invention, of a polyphase system consisting of n phases, only one phase is conducted during the period of one complete cycle—and we shall consider this as a first phase; this phase is then separated and the second phase is conducted as close in time as possible to the prior phase during the cycle that is closest but not simultaneous to the prior one; this phase is also separated and put aside and the third phase is conducted during the cycle that is closest to the second consecutive but not simultaneous to same, and thus onward until the n number of phases are completed, after which the first part is repeated to start over again. The simultaneousness mentioned naturally refers to the coexistence of energy (voltage) in two consecutive phases at the same instant.

The conduction angle that the process requires is simultaneously controlled within the complete cycle of conduction of each phase.

BRIEF DESCRIPTION OF THE DRAWINGS

FIGS. 6–9 are schematic diagrams of electrical components which may be used in place of the boxes labelled "E" in FIGS. 4 and 5;

FIG. 2 illustrates, on a wave diagram of a hexaphase system, the conduction cycles referred to in this invention; the first, second and third phases are detailed as A, B and C, respectively, while the conduction cycles of the fourth fifth and sixth are not shown as this is not necessary.

FIG. 2 shows the pause or non-conduction time corresponding to the angle which is a secondary consequence of the process. The value of the angle $\sigma$ is 360/n; the greater the number of cycles of the system the lesser or smaller shall $\sigma$ be. Thus, in a system having a big number of phases, the resulting wave should be quite similar to that produced by a monophase system but with the advantage of using a polyphase system as a source of electrical energy.

FIG. 3 illustrates, on a diagram the same as that of FIG. 2, the result of controlling the conduction angle $\alpha$ in order to obtain an alternating voltage with an effective value that would be a function of said angle $\alpha$.

There are several electronic components capable of allowing the passage of current under the conditions mentioned above, amongst which we shall mention thyristors connected in parallel and inverted, triacs, and transistors combined with rectifiers. These electronic means are intercalated in each of the branches of the polyphase feed system depending on the various circuits, which could be those detailed in FIGS. 4 and 5 for three-phase systems where E are these mentioned means and S the control orders for their activation, that will come from a programming system; any other circuit that would allow the successive circulation of cycles as described in this specification is allowed.

Figure 1:
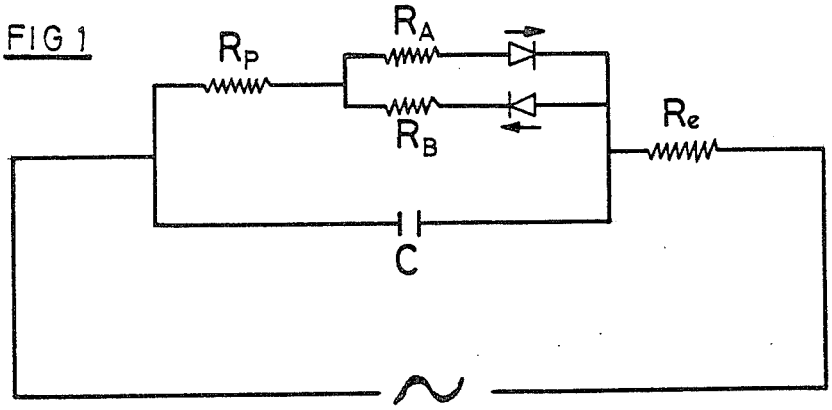
FIG. 1 is a schematic diagram of the electrical characteristics of the elements which form the electrolytic coloring process of the present invention.
Figure 2:
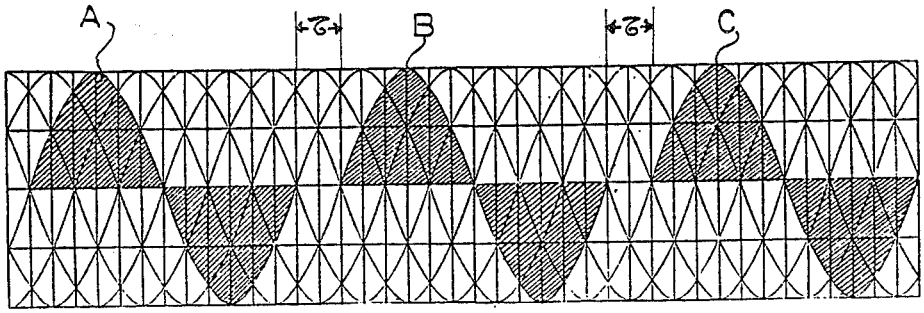
FIG. 2 is a wave diagram of a hexaphase system upon which the conduction cycles of the present invention are represented.
Figure 3:
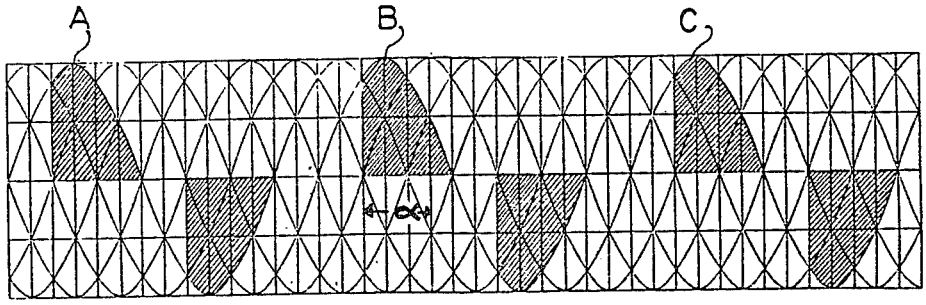
FIG. 3 is another hexaphase system wave diagram which illustrates thereon the results of controlling the conduction angle when using the present invention.
Figure 4:
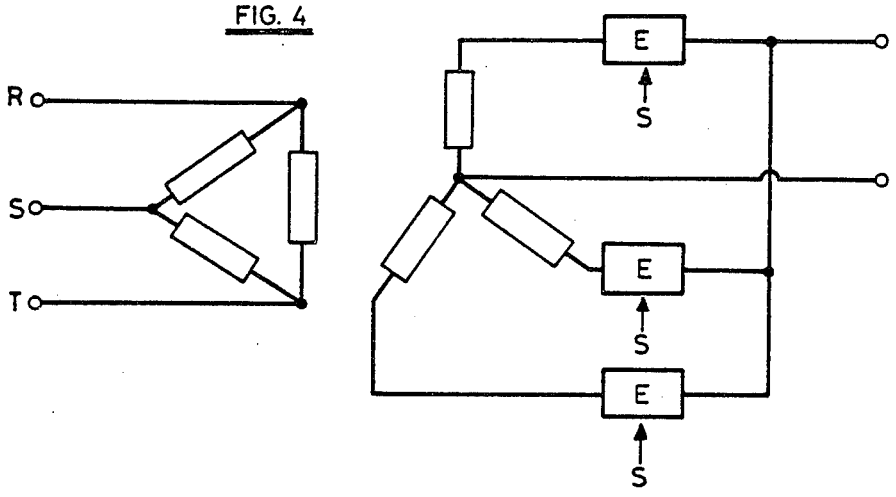
FIGS. 4 and 5 are schematic diagrams of three-phase electrical circuits for use with the present invention.
Figure 5:
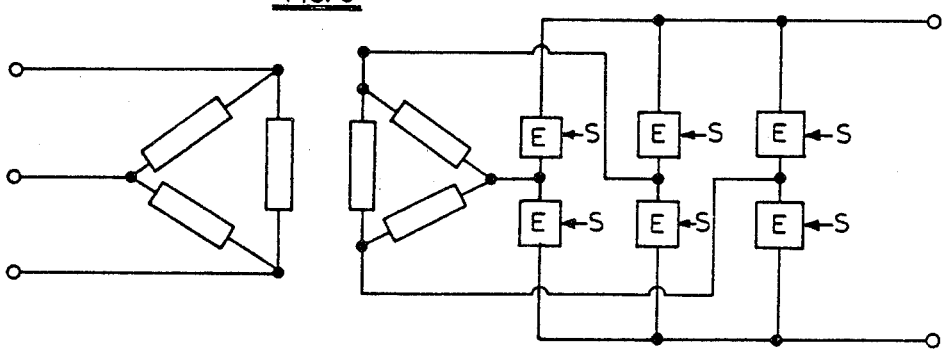

FIGS. 6, 7, 8 and 9 represent the symbols of E means shown in FIGS. 4 and 5, and which represent thyristors, triacs, and the rectifier/transistor combination, respectively.

The use of controlled thyristors or rectifiers connected in parallel and with their polarity inverted allows, by acting on the doors of both components, selection of the conduction cycle required as well as the conduction angle in order to obtain the division of loads in the polyphase system and the conduction angle corresponding to the required value of the alternating current as applied to the electrochemical process.

The use of triacs allows the same conditions of work as those of thyristors but the order of the control of cycle and conduction angle is communicated to only one door, given that this is precisely the characteristic of this component.

Figure 10:
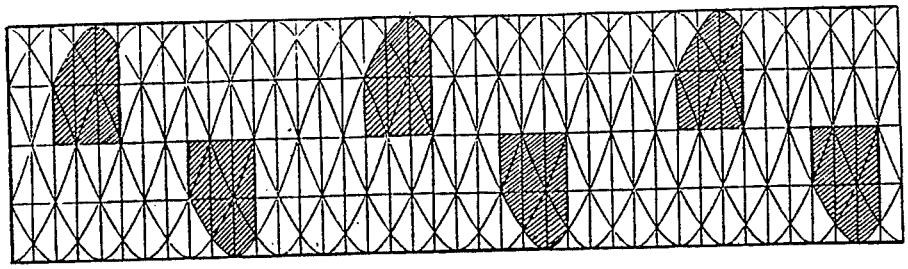
FIG. 10 is a hexaphase system diagram in which the control of the conduction angle of the present invention is accomplished by the use of transistors.

The use of transistors allows, in addition to the advantages detailed for thyristors and triacs, the control of the conduction angle at the start and at the end on a totally predetermined basis, as is shown in FIG. 10, of course with different firing or activation circuits as compared to those of thyristors and triacs; in this manner, the effectivity is optimized upon use of the maximum energy wave area.

Thyristors connected in parallel and inverted, the triac, and the combination of transistor with rectifier also work, with corresponding orders from the firing control circuit, as rectifier units with conduction angle control; in this manner, the electrolytic vat is supplied with pulsing continuous current of a value that is efficiently variable, used to effect an electrolytic decoloring in case an excessive coloring should have been effected by the prior stage.

Figure 11:
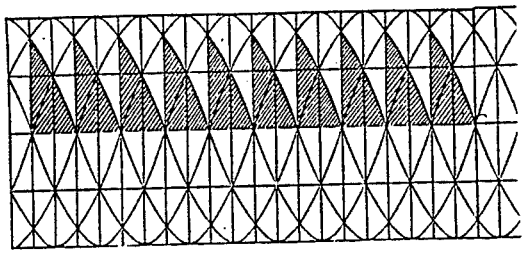
FIG. 11 is a hexaphase system diagram in which the rectifier wave of the present invention is controlled by means of non-parallel thyristors or triacs.
Figure 12:
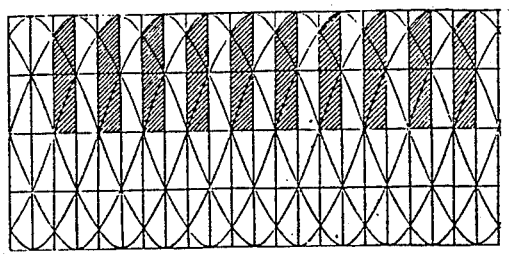
FIG. 12 is a hexaphase system diagram showing the rectifier wave of the present invention when controlled using transistors.

The rectifier wave, in cases of control by means of non-parallel thyristors or triacs, is shown in FIG. 11 on a diagram, similar to the prior ones, of a hexaphase system. FIG. 12 shows the wave form upon using transistors; in this specific case the transistor T2 of FIG. 8 would stop conducting and thyristors TR1 and TR 2 of FIG. 9 in like manner, in order to obtain this result.

The preparation of the firing orders S mentioned in FIGS. 4 and 5 for controlling the commutation of the conduction of phases, conduction angles and the functioning of the source as a rectifier, can be effected through multiple electronic means already known. The use of microprogrammers, by means of programs to be used for each electrochemical process, allows activating the source in any of the ways indicated, in a completely automatic manner and control of phases and conduction angles that are very exact. The programs required for each process are recorded in the memory of the microprocessor, which allows a great variety of these.

Following are examples of the invention in actual practice, with these being considered simply an illustration of the invention and in no way should be considered as a limitation of the scope of said invention.

EXAMPLE 1

A section (profile) of aluminum is subjected to prior anodization in a bath composed of sulfuric acid at a concentration of 180 gm/lt., at a temperature of 20° C., a current density of 1.5 amp/dm$^2$, and a period of time of 35 minutes.

The anodized section or profile, resulting from the above, is subjected to the different stages of the process of this invention in the following manner:

1. Precoloring Stage

The anodized section is treated in a bath composed of sulfuric acid (2 gm/lt) and citric acid (15 gm/lt), by applying alternating current at a voltage of 62 volts (peak) during 3 minutes at a current density of 0.25 amp/dm$^2$.

2. Coloring Stage

The section resulting from the prior stage is subjected to electrolytic coloring in a bath composed of the following:

$NiSO_4.7H_2O$—35 gm/lt
$(NH_4)_2SO_4$—20 gm/lt
$BO_3H_3$—30 gm/lt
$H_2SO_4$—up to a ph of 4.3-4.8 by means of the application of an alternating current at a peak voltage of 65 volts and a current density of 0.25 amp/dm$^2$, in order to obtain the following colors in the indicated times:

Light bronze—1 minute
Medium bronze—2 minutes
Dark bronze—3 minutes
Black bronze—10 minutes

EXAMPLE 2

The prior anodization of Example 1 is repeated, and the anodized section is afterwards subjected to the precoloring and coloring stages of the invention under the following conditions:

1. Precoloring Stage

In this example, the precoloring bath is composed of sulfuric acid at a concentration of 4 gm/lt. The alternating current is applied at a peak voltage of 65 volts, at a density of 0.28 amp/dm$^2$, during 2 minutes.

2. Coloring Stage

The coloring bath is composed of $CuSO_4$ at a concentration of 20 gm/lt, and $H_2SO_4$ in an amount sufficient to maintain a pH in the bath of 1.1. Alternating current is applied at a peak voltage of 70 volts at a current density of 0.32 amp/dm$^2$, in order to obtain the following colors in the indicated times:

Rosette (rose)—30 seconds
Medium red—90 seconds
Dark red—3 minutes

EXAMPLE 3

The prior anodization of Example 1 is repeated, and the anodized section is afterwards subjected to the precoloring and coloring stages of the invention:

1. Precoloring Stage

The section is treated in a bath composed of sulfuric acid (3 gm/lt) and citric acid (20 gm/lt), by means of the application of an alternating current at a peak voltage of 70 volts, a current density of 0.27 amp/dm$^2$, for 2.5 minutes.

2. Coloring Stage

In this stage, the treatment bath is composed of the following:

$NiSO_4.7H_2O$—35 gm/lt
$SnSO_4$—10 gm/lt
Phenylsulphonic acid—2 gm/lt
$H_2SO_4$—up to a pH of 0.95

Alternating current is applied at a peak voltage of 70 volts, a current density of 0.34 amp/dm$^2$, in order to obtain the following colors in the indicated times:

Light bronze—1 minute
Medium bronze—2 minutes
Dark bronze—3 minutes
Black bronze—10 minutes

I claim:

1. An electrolytic coloring process for aluminum or aluminum alloy sections which have been previously subjected to anodic oxidation, characterized by the following stages:

(a) subjecting an aluminum or aluminum alloy section which has been previously subjected to anodic oxidation to electrolytic treatment, in the absence of metal salts, in an electrolyte of a low power of disolution having a concentration in H+ equivalent to an $H_2SO_4$ solution of less than 4 gm/lt. by applying an alternating current having a peak voltage of between 55 and 85 volts and a current density of less than 0.3 amp/dm$^2$, said current being derived from the secondary branches of a polyphase transformer wherein the current is controlled so that a first phase is connected to apply one cycle of alternating current to the section, the first phase is disconnected and a second phase, which is the next consecutive phase after the first phase, is connected to apply one cycle of alternating current, the second phase is disconnected and a third phase is connected, and so on until each phase of the polyphase current has been sequentially connected to apply one cycle of alternating current to the section, said one cycle being composed of a positive half cycle and a negative half cycle, and wherein the positive and negative half cycles have the same conduction angle; and (b) electrolytically coloring the treated section in an acid electrolyte containing a metal salt or salts, using alternating current at a peak voltage of between 55 and 85 volts, obtained from the same source of current use in the electrolytic treatment stage.

2. The process according to claim 1, wherein each branch of the secondary of the polyphase transformer includes a bidirectional thyrister (triac), wherein during a stage subsequent to stage (b) said bidirectional thyrister (triac) operates as a rectifier controlling the conduction angle in order to produce an electrolytic decoloration in the event of excessive coloring produced during the electrolytic coloring stage (b).

3. The process according to claim 1, wherein each branch of the secondary of the polyphase transformer includes two thyristers connected in parallel and inverted with respect to each other, wherein during a stage subsequent to stage (b) said thyristers operate as a rectifier controlling the conduction angle in order to produce an electrolytic decoloration in the event of excessive coloring produced during the electrolytic coloring stage (b).

* * * * *